US008027612B2

(12) United States Patent
Soda

(10) Patent No.: US 8,027,612 B2
(45) Date of Patent: Sep. 27, 2011

(54) IMAGE FORMING APPARATUS HAVING A CHARGE MEMBER DISPOSED NEAR AN IMAGE BEARING MEMBER

(75) Inventor: Takamitsu Soda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 641 days.

(21) Appl. No.: 12/061,318

(22) Filed: Apr. 2, 2008

(65) Prior Publication Data

US 2008/0253807 A1 Oct. 16, 2008

(30) Foreign Application Priority Data

Apr. 13, 2007 (JP) ..... 2007-106478

(51) Int. Cl.
*G03G 15/16* (2006.01)

(52) U.S. Cl. ..... 399/101; 399/129

(58) Field of Classification Search ..... 399/101, 399/128, 129, 302
See application file for complete search history.

(56) References Cited

U.S. PATENT DOCUMENTS 5,809,373 A * 9/1998 Yoda et al. ..... 399/101
5,991,566 A * 11/1999 Tanaka et al. ..... 399/101
6,856,777 B2 * 2/2005 Enomoto et al. ..... 399/129
6,879,801 B2 4/2005 Soda et al.
7,085,524 B2 8/2006 Soda et al.
7,190,919 B2 3/2007 Kitagawa

FOREIGN PATENT DOCUMENTS

JP 10-312116 A 11/1998
JP 2004-102018 A 4/2004
JP 2005-284186 A 10/2005
JP 2005-326758 A 11/2005

* cited by examiner

*Primary Examiner* — William J Royer
(74) *Attorney, Agent, or Firm* — Fitzpatrick, Cella, Harper & Scinto

(57) ABSTRACT

Provided is an image forming apparatus having a charge brush for charging a transfer residual toner remaining on an intermediate transfer member. A toner is adhered to the charge brush. While a charge voltage is applied to the charge brush, the toner adhered to the charge brush is attracted by an electric field onto the charge brush. However, when the charge voltage is not applied to the charge brush, the toner adhered to the charge brush is moved to the intermediate transfer member. When a subsequent toner image is formed on the toner adhered to the intermediate transfer member, the quality of the subsequent image is deteriorated. Accordingly, the charge voltage is applied to the charge brush when an intermediate transfer area to which the toner image is transferred onto the intermediate transfer member immediately afterward faces the charge brush.

11 Claims, 6 Drawing Sheets

IMAGE FORMING APPARATUS HAVING A CHARGE MEMBER DISPOSED NEAR AN IMAGE BEARING MEMBER

BACKGROUND OF THE INVENTION

1. Field of the Invention

The present invention relates to an image forming apparatus having a charge member disposed near an image bearing member.

2. Description of the Related Art

Conventionally, as an image forming apparatus such as a copying machine and a laser beam printer, there has been known an image forming apparatus employing an intermediate transfer system with an intermediate transfer member. In the image forming apparatus employing the intermediate transfer system, first, as a primary transfer process, a toner image, which is a transferable image formed on a surface of a photosensitive member serving as a first image bearing member, is transferred onto an intermediate transfer member serving as a second image bearing member. The primary transfer process is repeatedly executed for each of multiple color toner images, to thereby form multiple color toner images on a surface of the intermediate transfer member. After that, as a secondary transfer process, the multiple color toner images formed on the surface of the intermediate transfer member are collectively transferred onto a surface of a transfer material such as paper. Then, the multiple color toner images collectively transferred onto the transfer material are fused and mixed to be fixed onto the transfer material by a fixing unit. As a result, for example, a full-color image as a recorded image is formed on the transfer material.

As a method of collecting a toner (secondary transfer residual toner) remaining on the intermediate transfer member after the secondary transfer process, there is known a method of charging the residual toner to a polarity opposite to a normal charging polarity by a charge member and transferring the residual toner back to the photosensitive member during the primary transfer process, to thereby collect the residual toner (see Japanese Patent Application Laid-Open No. 2005-284186).

While the charge member disclosed in Japanese Patent Application Laid-Open No. 2005-284186 is a roller, a charge brush is used as the charge member in the present invention in order to improve a charging ability of the charge member. The charge brush is advantageous in that a diffusion effect by the brush is expected in a case of charging a toner, and in that a charging efficiency of the toner is improved.

Meanwhile, the charge brush has a brush shape, so the charge brush is liable to store (hold) toner as compared with the roller. When an amount of the toner to be held is large, a large amount of toner is removed from the charge brush when a voltage applied to the charge brush is switched or turned off. In a case where a subsequent toner image is superimposed on the toner, which is removed from the charge brush, to be formed on the intermediate transfer member, there arises a problem in that the quality of the subsequent toner image is deteriorated.

SUMMARY OF THE INVENTION

The present invention has been made to solve the above-mentioned problem, and therefore an object of the present invention is to suppress deterioration of an image quality due to contamination of an intermediate transfer member caused by a charge brush. Another object of the present invention is to provide an image forming apparatus, including an image bearing member that bears a toner image; an intermediate transfer member on which the toner image is transferred as a primary transfer from the image bearing member, the toner image on the intermediate transfer member being transferred onto a recording material as a secondary transfer, the intermediate transfer member being movable; a power supply; and a brush-shaped charge brush on which a charge voltage is charged from the power supply, for charging a residual toner remaining on the intermediate transfer member after the secondary transfer, wherein during a time period when an area on the intermediate transfer member which is first subjected to the primary transfer in an operation of the image forming apparatus, the power supply continuously outputs a voltage with a polarity that is the same as a polarity of the charge voltage during a time period when the area passes through a position facing the charge brush.

Further features of the present invention will become apparent from the following description of exemplary embodiments with reference to the attached drawings.

DESCRIPTION OF THE EMBODIMENTS

Hereinafter, exemplary embodiments of the present invention will be described in detail with reference to the drawings. Note that dimensions, materials, shapes, relative arrangement, and the like of structural parts described in embodiments of the present invention below should be appropriately changed in accordance with the structure of an apparatus and various conditions to which the present invention is applied. Accordingly, unless otherwise specified, it is to be understood that the scope of the present invention is not limited thereto.

Hereinafter, an image forming apparatus according to the present invention will be described in detail with reference to the drawings.

Embodiment 1

(Entire Structure and Operations of Image Forming Apparatus)

Figure 1:
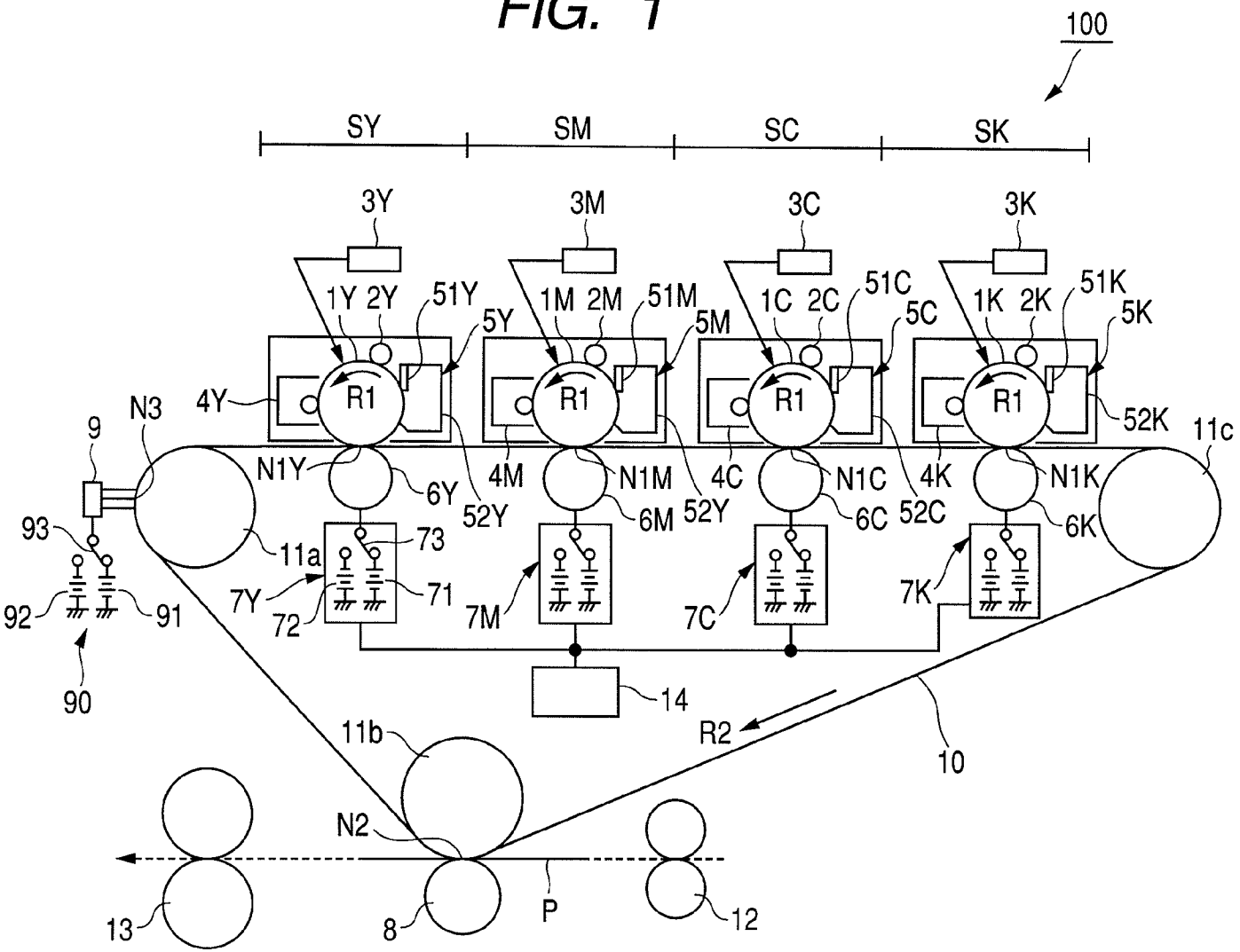
FIG. 1 is a schematic block diagram illustrating an example of an image forming apparatus according to Embodiment 1 of the present invention.

FIG. 1 is a schematic block diagram illustrating an example of a color image forming apparatus of an intermediate transfer system employing an electrophotographic process according to an embodiment of an image forming apparatus of the present invention.

An image forming apparatus 100 includes, as multiple image forming portions, four image forming portions (stations) for forming a toner image for each color of yellow, magenta, cyan, and black, that is, a first image forming portion SY, a second image forming portion SM, a third image forming portion SC, and a fourth image forming portion SK. Note that, in the image forming apparatus 100 according to Embodiment 1 of the present invention, the image forming portions SY, SM, SC, and SK are substantially common in structure and operation except for the color of a toner image formed by each of the image forming portions. Accordingly, in the following description, the structural components will be described as a whole, unless specific distinction is necessary, the suffixes Y, M, C, K added to reference numerals are omitted to represent an element provided for any one of the colors.

Each image forming portion S includes a drum-type electrophotographic photosensitive member serving as an image bearing member (electrostatic latent image bearing member), that is, a photosensitive drum 1. The photosensitive drum 1 is formed by coating an organic photoconductor (OPC), or a photoconductive member made of amorphous silicon (A-Si), CdS, Se, or the like on an outer peripheral surface of a cored bar made of aluminum or the like. In Embodiment 1, an organic photoconductor is used. The photosensitive drums 1 of the image forming portions S are arranged in order along an intermediate transfer belt 10 serving as an intermediate transfer member which also functions as an image bearing member to be described later. Each photosensitive drum 1 is rotationally driven by a drive unit such as a motor (not shown) in a direction indicated by an arrow R1 of FIG. 1 (counterclockwise) at a predetermined peripheral speed (process speed).

Each image forming portion S includes a charging roller 2 serving as a primary charging unit, an exposure device (laser scanner) 3 serving as exposure means, and a developing apparatus 4 serving as a developing unit which are formed near the photosensitive drum 1. Each image forming portion S further includes a primary transfer roller 6 serving as a primary transfer member (rotary member) which forms a primary transfer unit, and a cleaner 5 serving as a cleaning unit. Each cleaner 5 includes a cleaning blade 51 serving as a cleaning member for scraping off and removing a toner remaining on a surface of the photosensitive drum 1, and a waste toner container 52 for collecting the toner removed by the cleaning blade 51.

The photosensitive drum 1, the charging roller 2 serving as a process unit acting on the photosensitive drum 1, the developing apparatus 4, and the cleaner 5 may be integrally formed into a cartridge to thereby form a process cartridge detachably mounted to an image forming apparatus main body (hereinafter, referred to as "apparatus main body"). In the structure, in a case of replacing the process cartridge, the waste toner container 52 in which the residual toner and the like are collected can also be replaced at the same time.

The endless belt-like intermediate transfer belt (ITB) 10 serving as an intermediate transfer member is disposed so as to face the photosensitive drum 1 of each image forming portion S. As a material of the intermediate transfer belt 10, rubber such as ethylene-propylene-diene (EPDM), nitrile-butadiene rubber (NBR), urethane, and silicone rubber can be suitably used. Alternatively, as the material of the intermediate transfer belt 10, there can be suitably used a resin such as polyimide (PI), polyamide (PA), polycarbonate (PC), polyvinylidene-fluoride (PVDF), ethylene-tetrafluoroethylene copolymer (ETFE), polyethylene terephthalate (PET), PC/PET, ETFE/PET, or the like. In Embodiment 1, as the intermediate transfer belt 10, there is employed an endless belt-like film made of PVDF and having an electrical resistance value (volume resistivity) adjusted to $10^{11}$ Ω·cm. The intermediate transfer belt 10 is suspended over three rollers (support rollers) serving as multiple supporting members including a drive roller 11*a*, a secondary transfer facing roller 11*b*, and a tension roller 11*c*. The drive roller 11*a* is rotationally driven by a drive unit such as a motor (not shown) so as to roatatively move the intermediate transfer belt 10 in a direction indicated by an arrow R2 of FIG. 1 (clockwise) at a predetermined peripheral speed (process speed).

The primary transfer roller 6 is disposed at a position facing the photosensitive drum 1 through the intermediate transfer belt 10. The primary transfer roller 6 has a conductive sponge layer formed on a shaft thereof. Further, the primary transfer roller 6 comes into contact with the photosensitive drum 1 through the intermediate transfer belt 10. In other words, each primary transfer roller 6 presses the intermediate transfer belt 10 against the photosensitive drum 1 at an inner peripheral side of the intermediate transfer belt 10, and forms a primary transfer portion (primary transfer nip portion) N1 at which the intermediate transfer belt 10 and the photosensitive drum 1 are brought into contact with each other. At a position facing the secondary transfer facing roller lib through the intermediate transfer belt 10, is disposed, a secondary transfer roller 8 as a secondary transfer member (rotary member) forming a secondary transfer unit. The secondary transfer roller 8 is brought into contact with the intermediate transfer belt 10, to thereby form a secondary transfer portion (secondary transfer nip portion) N2.

Next, a description is given of a process for forming a full-color image. The photosensitive drum 1 is rotationally driven by a drive unit (not shown) in the direction indicated by the arrow R1 of FIG. 1, and is uniformly charged to a predetermined potential by the charging roller 2. Then, exposure is started by the exposure device 3, and the photosensitive drum 1 whose surface is uniformly charged is scanned with light in response to a signal representing an image pattern of each color corresponding to each image forming portion S, whereby an electrostatic image (latent image) is formed on the photosensitive drum 1. In this case, the exposure is started in synchronization with a timing at which a leading end of an image portion on the intermediate transfer member enters the primary transfer portion N1 of each image forming portion S so that an image can be transferred to a position on the intermediate transfer belt 10 (hereinafter, referred to as "image portion on intermediate transfer member") to which the image is intended to be transferred. Note that the synchronization between the timing for forming a latent image and the timing for the leading end of the image portion on the intermediate transfer member to enter the primary transfer portion N1 of each image forming portion S is performed by monitoring a timing at which a TOP sensor (not shown) detects a TOP seal (not shown) provided on the intermediate transfer belt 10.

After the latent image formation is started, when the photosensitive drum 1 is further rotated in the direction indicated by the arrow R1 of FIG. 1, development is carried out by the developing apparatus 4. The developing apparatus 4 includes a developing roller serving as a developer bearing member which is formed in a portion facing the photosensitive drum 1 and rotates at a predetermined rotational speed. The latent image formed on the photosensitive drum 1 is visualized with the toner which is constantly supplied into the developing apparatus 4 to be carried on a surface of the developing roller and which is charged to a negative polarity (normal charging polarity of toner in Embodiment 1 of the present invention). In this case, due to a potential difference between the developing roller of the developing apparatus 4 and the photosensitive drum 1, that is, a developing bias, the negatively charged toner is not moved to the photosensitive drum 1 from the developing apparatus 4 in a non-latent image forming portion on the photosensitive drum 1. Meanwhile, the potential difference only in the portion on the photosensitive drum 1, in which the latent image is formed, is changed, to thereby move the toner to the photosensitive drum 1. For this reason, only the latent image forming portion on the surface of the photosensitive drum 1 is visualized with the toner. Note that, in general, the developing bias is applied to the developing roller by a developing bias power supply (high voltage power supply) serving as a developing voltage applying unit.

Note that, in Embodiment 1 of the present invention, the developing apparatus 4 develops the electrostatic image by a reverse development process. In other words, the developing apparatus 4 causes the toner, which is charged to a normal polarity which is the same polarity as the charging polarity of the photosensitive drum 1, to be adhered to a portion (light portion) on the photosensitive drum 1 in which a charge is attenuated by the exposure after a charging process, to thereby form a toner image on the photosensitive drum 1. Though the developing apparatus 4 is not limited thereto, as a developer, for example, a non-magnetic one-component developer, that is, toner can be suitably used.

The photosensitive drum 1 is further rotated in the direction indicated by the arrow R1 of FIG. 1, and when the toner image developed on the photosensitive drum 1 reaches the primary transfer portion N1, the toner image is transferred (primarily transferred) onto the intermediate transfer belt 10. In this case, to each primary transfer roller 6, a primary transfer bias with a positive polarity (polarity opposite to normal charging polarity of toner of Embodiment 1 of the present invention) is applied from a primary transfer bias power supply (high voltage power supply) 7 serving as a primary transfer voltage applying unit, with the cored bar of the photosensitive drum 1 being used as an opposite electrode. As a result, onto the image portion on the intermediate transfer member which enters the primary transfer portion N1 so as to be synchronized in the above-mentioned manner, the toner image is primarily transferred from the photosensitive drum 1. Due to the primary transfer bias, there is formed an electric field in a direction (polarity) in which the toner charged to the normal charging polarity is caused to move toward the intermediate transfer belt 10 from the photosensitive drum 1.

In the case of forming a full-color image, the above-mentioned processes of charging, exposure, development, and primary transfer are carried out in each of the first image forming portion SY, the second image forming portion SM, the third image forming portion SC, and the fourth image forming portion SK. Four color images are sequentially primarily transferred onto the image portion on the intermediate transfer member. As a result, the four color toner images are superimposed on the intermediate transfer belt 10.

After the primary transfer process, the toner (primary transfer residual toner) remaining on the photosensitive drum 1 is cleaned by the cleaner 5 which brings the cleaning blade 51 into contact with the photosensitive drum 1 to scrape off the toner.

Note that, in order to carry out the primary transfer process satisfactorily while such conditions as high transfer efficiency and low re-transfer rate are satisfied, it is desirable that the positive primary transfer bias applied from the primary transfer bias power supply 7 to the primary transfer roller 6 be kept constant at an optimum value determined in consideration of environments and characteristics of the parts. The image forming apparatus 100 according to Embodiment 1 of the present invention includes a transfer current detection device (not shown) for detecting a transfer current generated in a primary transfer portion N1Y for a first color. The image forming apparatus 100 according to Embodiment 1 of the present invention further includes a controller or primary transfer bias control unit 14 capable of applying a predetermined voltage to each primary transfer bias power supply 7 by referring to detection results obtained from the transfer current detection device. The transfer current detection device may be configured as a current detection circuit to be incorporated in or connected to the primary transfer bias power supply 7 of the first image forming portion SY. Further, in Embodiment 1 of the present invention, the controller 14 for controlling operations of the image forming apparatus 100 as a whole has a function of the primary transfer bias control unit 14.

Note that, when impedance detection is performed, unlike Embodiment 1 of the present invention, current detection results obtained at the time of application of the predetermined voltage are not necessarily used. Alternatively, the impedance detection may be performed by use of voltage detection results obtained when a predetermined current is caused to flow. In this case, a voltage detection device (voltage detection circuit) may be provided in place of the current detection device.

Next, a description is given of a primary transfer control process for applying an optimum primary transfer bias during the primary transfer process by use of the transfer current detection device and the primary transfer bias control unit 14. The primary transfer control process includes control for detecting an impedance of the first transfer portion for the first color before image printing (hereinafter, referred to as "impedance detection control"), and control for calculating the optimum primary transfer bias by use of impedance detection results obtained by the impedance detection control to apply the optimum primary transfer bias during the primary transfer process. Specifically, the impedance detection control is performed in the following manner.

Figure 2:
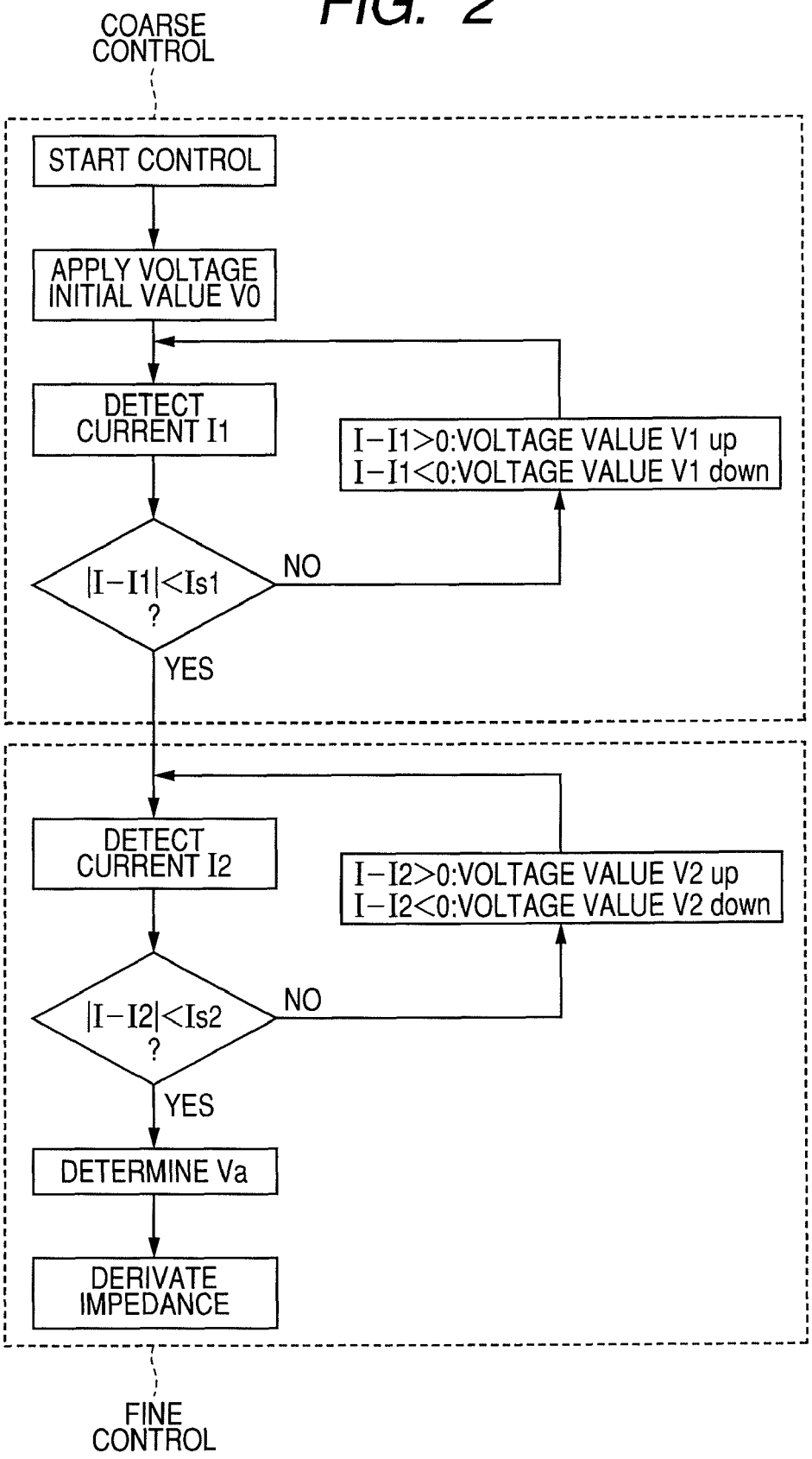
FIG. 2 illustrates an example of a flow of impedance detection control executed during printing.

FIG. 2 is a flowchart illustrating the impedance detection control. The impedance detection control includes coarse control and fine control, and a voltage Va for obtaining a target current I is derived so as to obtain an impedance of the first transfer portion. First, in the coarse control, a voltage initial value V0 is applied, and a current detection result I1 and the target current I are compared with each other. When an absolute value of a difference therebetween is Is1 or larger, a voltage output is shifted by V1 in a direction in which the current detection result I1 is made closer to the target current I. Such a process is repeatedly performed in a similar manner, and when the absolute value of the difference between the current detection result I1 and the target current I is smaller than Is1, the coarse control is finished. Then, the process proceeds to the fine control. A voltage obtained when the coarse control is finished is applied, and a current detection result I2 and the target current I are compared with each other. When an absolute value of a difference therebetween is Is2 or larger, a voltage output is shifted by V2 in a direction in which the current detection result I2 is made closer to the target current I. Such a process is repeatedly performed in a similar manner, and when the absolute value of the difference between the current detection result I2 and the target current I is smaller than Is2, the voltage is determined as the voltage Va for obtaining the target current I and the impedance is determined as Va/I, whereby the fine control is finished.

Then, referring to the impedance detection results, the primary transfer bias control unit 14 applies a voltage corresponding to such a value that a desired current flows during the primary transfer process. The primary transfer control process is performed in the above-mentioned manner.

When the four color toner images are primarily transferred onto the intermediate transfer belt 10, in synchronization with the rotation of the intermediate transfer belt 10, a transfer material P is transported from registration rollers 12 serving as a transfer material transport unit to the secondary transfer portion N2. In the secondary transfer portion N2, the secondary transfer roller 8 having the same structure as that of the primary transfer roller 6 is brought into contact with the intermediate transfer belt 10 through the transfer material P. Then, with the secondary transfer facing roller lib being used as an opposite electrode, a secondary transfer bias with a positive polarity (polarity opposite to normal charging polarity of toner of Embodiment 1 of the present invention) is applied from a secondary transfer bias power supply (high voltage power supply) (not shown) serving as a secondary transfer voltage applying unit to the secondary transfer roller 8. As a result, the four color toner images formed on the intermediate transfer belt 10 are collectively transferred (secondarily transferred) onto the transfer material P. Due to the secondary transfer bias, there is formed an electric field in a direction (polarity) in which the toner charged to the normal charging polarity is caused to move toward the transfer material P from the intermediate transfer belt 10.

The transfer material P having the four color toner images secondarily transferred thereto is heated and pressurized by a fixing device 13 serving as a fixing unit, whereby the toner images are fused and fixed onto the transfer material P. Thus, a color image as a recorded image is obtained.

The image forming apparatus 100 further includes a charge brush 9 serving as a brush-shaped charge member which forms a charging unit that comes into contact with the intermediate transfer belt 10 so as to charge the toner remaining on the intermediate transfer belt 10. The image forming apparatus 100 further includes a charge bias power supply (high voltage power supply) 90 serving as a charge voltage output unit for applying a voltage to the charge brush 9. The charge brush 9 applies the charge to the toner remaining on the intermediate transfer belt 10 downstream of the secondary transfer roller 8 (secondary transfer portion) and upstream of the image forming portion SY (primary transfer portion thereof), which is disposed most upstream of the multiple image forming portions S, in a movement direction of the intermediate transfer belt 10. Specifically, in Embodiment 1 of the present invention, the charge brush 9 comes into contact with the intermediate transfer belt 10 at a position facing the drive roller 11*a*, to thereby form a charging portion (contact portion) N3.

Then, the residual toner (secondary transfer residual toner) remaining on the intermediate transfer belt 10 after the secondary transfer process is uniformly applied with the charge having the positive polarity (polarity opposite to normal charging polarity of toner of Embodiment 1 of the present invention) by the charge brush 9. At that time, the charge brush 9 is applied with the voltage having the positive polarity by the charge bias power supply 90. Subsequently, the secondary transfer residual toner is delivered to the primary transfer portion N1Y for the first color. In this case, the secondary transfer residual toner is electrostatically transferred onto a photosensitive drum 1Y by a primary transfer roller 6Y to which the primary transfer bias having the positive polarity (polarity opposite to normal charging polarity of toner of Embodiment 1 of the present invention) is applied for the primary transfer process for a subsequent page. Then, the secondary transfer residual toner is removed from the intermediate transfer belt 10. In other words, the toner charged by the charge brush 9 is transferred onto the photosensitive drum 1 from the intermediate transfer belt 10 simultaneously with the primary transfer process. In the process for removing the secondary transfer residual toner, there is formed an electric field in a direction (polarity) in which the toner charged to a polarity opposite to the normal charging polarity is caused to move toward the photosensitive drum 1Y from the intermediate transfer belt 10, in the primary transfer portion N1Y. Then, the secondary transfer residual toner transferred onto the photosensitive drum 1Y is collected by a cleaner 5Y, whereby the process for removing the secondary transfer residual toner remaining on the intermediate transfer belt 10 is finished.

Specifically, in Embodiment 1 of the present invention, the charge brush 9 has conductive fibers transplanted into a base material. The conductive fibers are uniformly brought into contact with the entirety of the intermediate transfer belt 10 in a longitudinal direction so as to apply a high voltage thereto, whereby the toner is charged.

Thus, in Embodiment 1 of the present invention, the image forming apparatus 100 includes the charge brush 9 disposed downstream of the secondary transfer portion N2 and upstream of the primary transfer portion N1Y, and carries out a secondary transfer residual toner charging process for charging the toner remaining on the intermediate transfer belt 10 after the secondary transfer process to a predetermined polarity.

Figure 6:
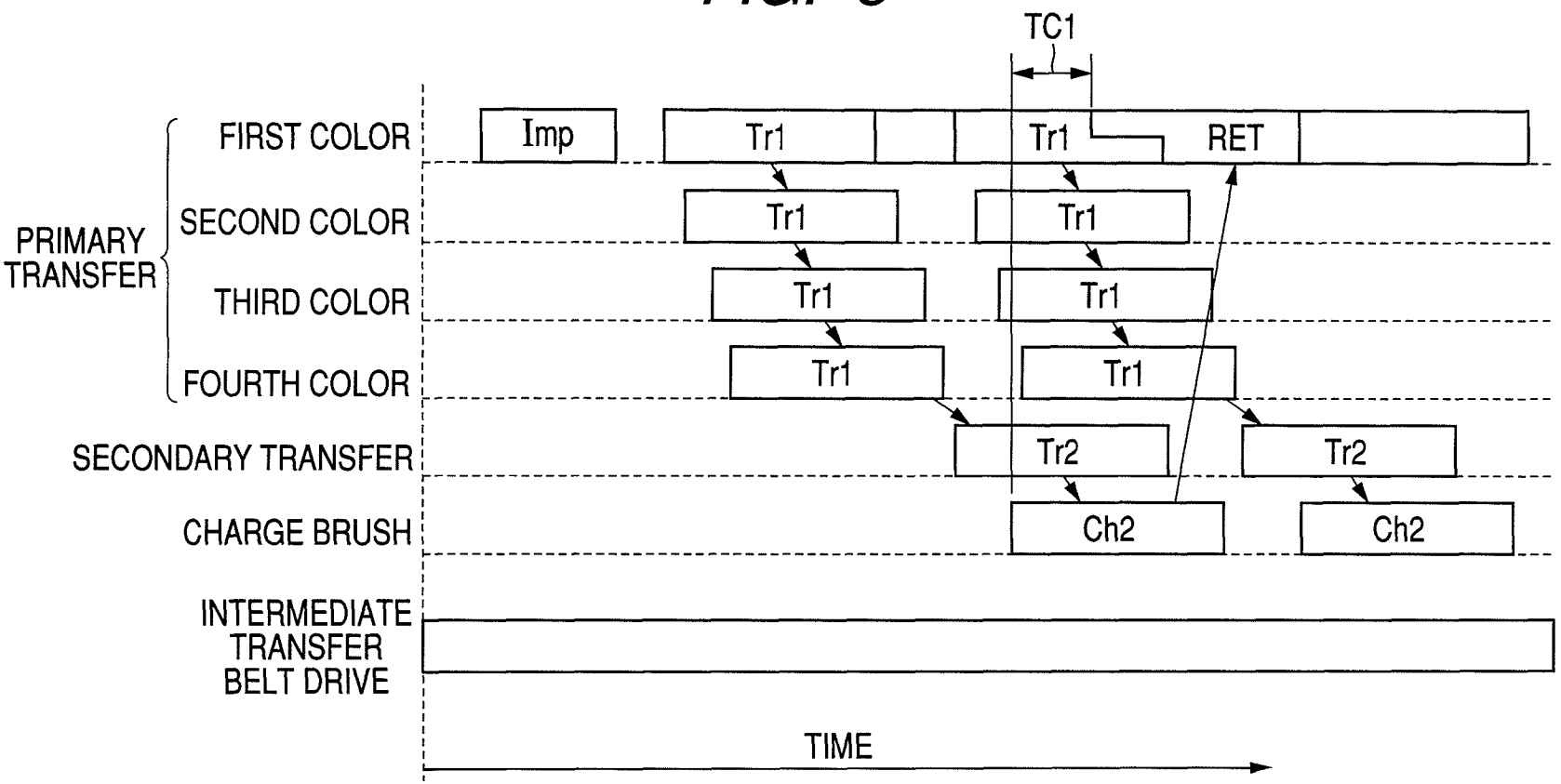
FIG. 6 is a sequence chart illustrating bias application timings in a secondary transfer residual toner removing process and a primary transfer control process according to a comparative example of the present invention, for facilitating the understanding of the embodiments of the present invention.

In this case, FIG. 6 is a sequence chart illustrating the secondary transfer residual toner removing process and the primary transfer control process according to a comparative example of the present invention, for the purpose of comparison with control according to an embodiment of the present invention to be described later. In FIG. 6, the impedance detection control is represented by "Imp", the primary transfer bias application is represented by "Tr1", and the secondary transfer bias application is represented by "Tr2". Further, in FIG. 6, the charging of the secondary transfer residual toner by the bias application of the charge brush 9 is represented by "Ch2", and the collection of the secondary transfer residual toner in the primary transfer portion by the primary transfer bias application is represented by "RET". Still further, in FIG. 6, a time (rotation time) required for movement from the contact portion N3 of the charge brush 9 to the primary transfer portion N1Y for the first color on the intermediate transfer belt 10 is represented by "TC1".

A series of operations for forming an image, that is, a printing sequence includes a pre-rotation process, a continuous image forming process, and a post-rotation process. In the pre-rotation process, the impedance detection control and the like are performed. In the continuous image forming process, the image forming process and the secondary transfer residual toner removing process are repeatedly performed, to thereby repeatedly perform the image forming process. In the post-rotation process, after the continuous image forming process, cleaning for the second image bearing member is performed.

Further, when the charging of the secondary transfer residual toner is repeated, the toner is accumulated between the fibers of the charge brush 9, so a charge brush cleaning process for cleaning the charge brush 9 can be carried out.

Figure 3:
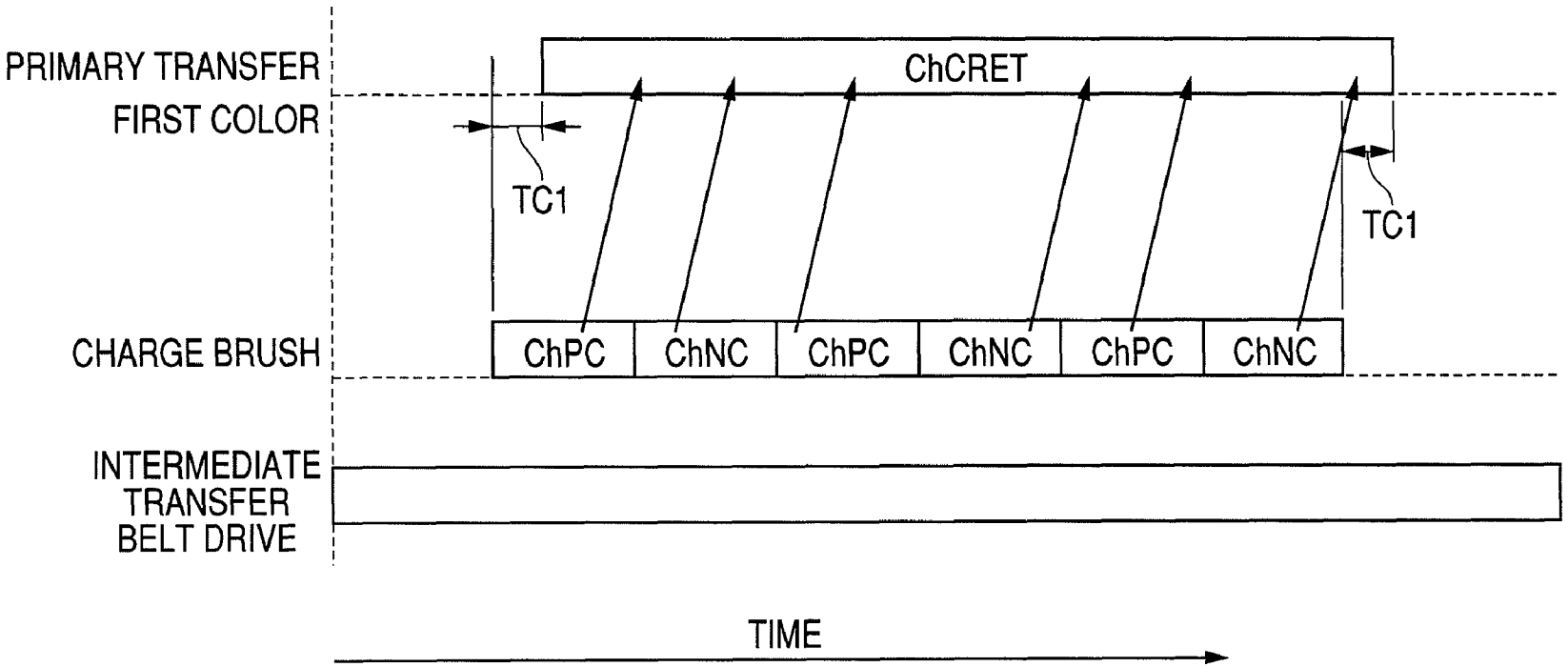
FIG. 3 is a sequence chart illustrating an example of bias application timings in a charge brush cleaning process.

FIG. 3 is a timing chart illustrating the charge brush cleaning process. In FIG. 3, the application of a positive bias to the charge brush 9 is represented by "ChPC", the application of a negative bias to the charge brush 9 is represented by "ChNC", and the application of a negative bias to the primary transfer roller 6 is represented by "ChCRET". The time "TC1" is similar to that of FIG. 6.

Specifically, "ChPC" and "ChNC" represent that the positive bias and the negative bias are alternately applied to the charge brush 9 during a time period when the intermediate transfer belt 10 is driven. By the bias application, the negatively charged toner, which is not charged to the positive polarity at the time of charging the secondary transfer residual toner to be accumulated in the charge brush 9, is discharged onto the intermediate transfer belt 10. By the application of the bias, which is represented by "ChCRET", having the negative polarity (same polarity as normal charging polarity of toner of Embodiment 1 of the present invention) to the primary transfer roller 6Y of the primary transfer portion N1Y for the first color, the toner is electrostatically transferred onto the photosensitive drum 1Y, and is removed from the intermediate transfer belt 10. In the charge brush cleaning process, there is formed an electric field in a direction (polarity) in which the toner charged to the normal charging polarity is caused to move toward the photosensitive drum 1Y from the intermediate transfer belt 10, in the primary transfer portion N1Y. Then, the toner which is transferred onto the photosensitive drum 1Y and discharged from the charge brush 9 is collected by the cleaner 5Y, whereby the charge brush cleaning process is finished. Note that, in general, the charge brush cleaning process is executed after the post-rotation process of the printing sequence and the like.

Specifically, the primary transfer control process in a full-color plain paper printing mode, for example, can be executed by the following settings. That is, during a time period before the primary transfer process for the first color on a first page, the impedance detection control is performed assuming that the voltage initial value V0 is set to 300 V, the target current I is set to 5 μA, Is1 is set to 0.5 μA, V1 is set to 20 V, Is2 is set to 0.1 μA, and V2 is set to 5V. During the primary transfer process, voltages are calculated and applied so that the transfer current is set to 4 μA for the first color, and the transfer current is set to 5 μA for second to fourth colors. The voltage application is continuously performed after the primary transfer process for the first page until the sequence is finished.

Specifically, the secondary transfer residual toner removing process illustrated in FIG. 6 can be executed by the following settings, for example. That is, a charge bias of 1.2 kV is applied to the charge brush 9 only when the secondary transfer residual toner is charged. In the primary transfer portion N1, the primary transfer of the image onto the intermediate transfer belt 10 and the collection of the toner to the photosensitive drum 1 are performed.

Specifically, the charge brush cleaning process illustrated in FIG. 3 can be executed by the following settings, for example. That is, voltages of +300 V and −300 V are alternately applied to the charge brush 9 for 200 ms three times, whereby the accumulated toner is discharged onto the intermediate transfer belt 10. Then, in the primary transfer portion N1, a voltage of −500 V is applied, whereby the toner remaining on the intermediate transfer belt 10 is collected to the photosensitive drum 1.

(Voltage Application to Charge Brush)

As described above, in Embodiment 1 of the present invention, the brush-shaped charge brush 9 which is excellent in charging ability is used as the charge member. The charge brush 9 is brought into contact with the intermediate transfer belt 10 so as to charge the toner remaining on the intermediate transfer belt 10 while agitating the toner, whereby the charging ability of the toner remaining on the intermediate transfer belt 10 is improved. In the image forming apparatus 100 having the above-mentioned structure, the secondary transfer residual toner collecting process is performed for each page to be printed, with the result that generation of an image defect, which is caused when the secondary transfer residual toner is superimposed on the toner of the printed image on the subsequent page on the intermediate transfer belt 10, can be suppressed. Further, in the image forming apparatus 100, by the application of the appropriate primary transfer bias, which is determined in consideration of the impedance of the intermediate transfer belt 10, a high-quality image can be provided.

However, as described above, in the case of using the charge member with the shape in which the toner in the charge brush 9 and the like is liable to be accumulated, even when the charge brush cleaning process is executed, it is difficult to satisfactorily perform the cleaning in a single printing sequence in some cases. For this reason, in some cases, there occurs an image defect due to the discharge of undesirable toner from the charge brush 9 during the rotation of the intermediate transfer belt 10, that is, mainly due to the discharge of the negatively charged toner accumulated in the charge brush 9.

A primary object of Embodiment 1 of the present invention is to suppress an image defect due to the operation of the charge member for charging the residual toner remaining on the intermediate transfer member. One of more specific objects of Embodiment 1 of the present invention is to suppress the image defect due to the discharge of the undesirable toner from the charge member during the rotation of the intermediate transfer member.

In Embodiment 1 of the present invention, the voltage to be applied to the charge brush 9 is controlled in a manner to be described in detail below.

Figure 4:
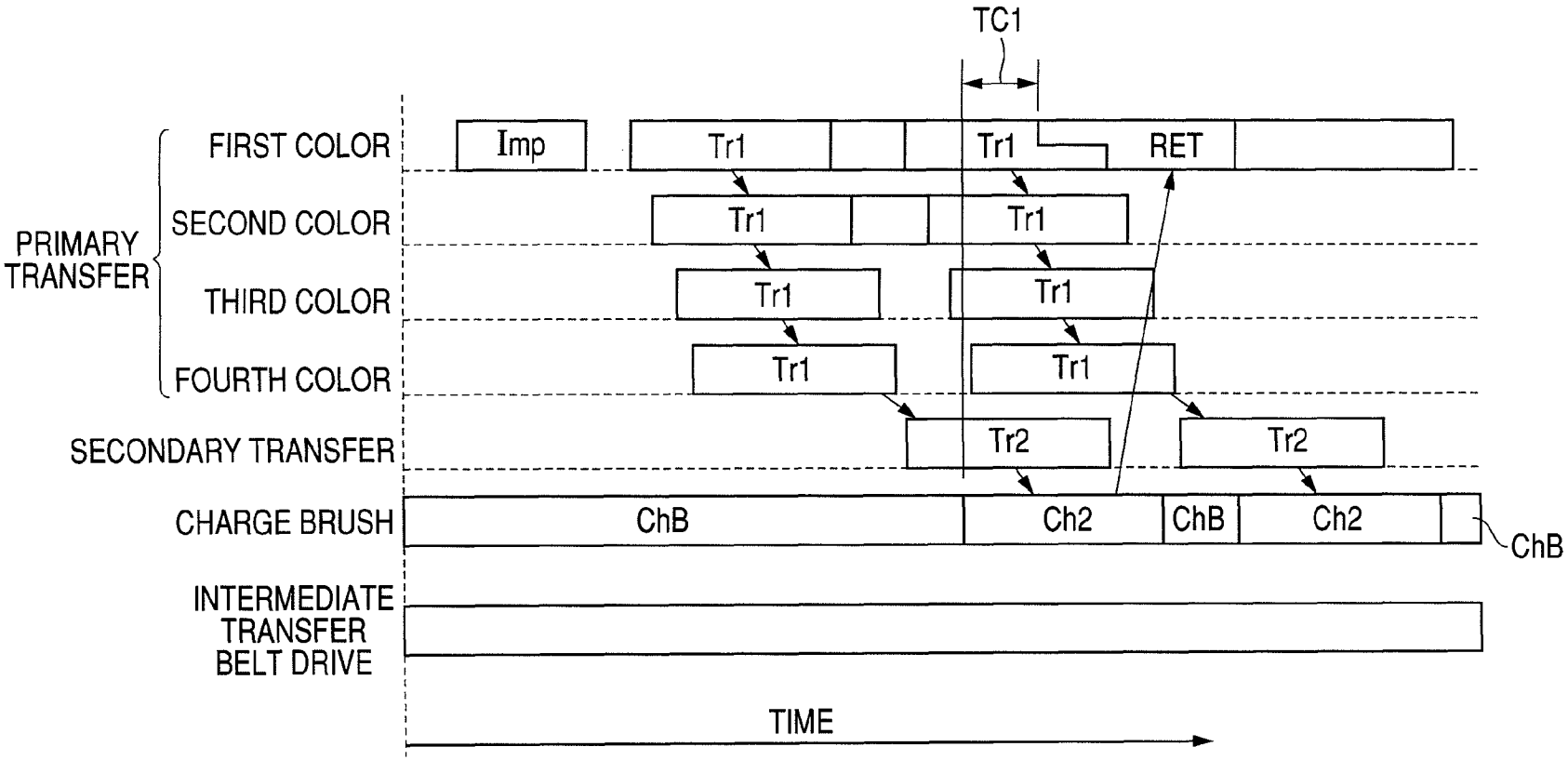
FIG. 4 is a sequence chart illustrating bias application timings in a secondary transfer residual toner removing process and a primary transfer control process according to Embodiment 1 of the present invention.

FIG. 4 is a diagram illustrating bias application timings in the primary transfer process and the subsequent process, which is performed so as to suppress the discharge of undesirable toner, during the printing sequence according to Embodiment 1 of the present invention. In FIG. 4, "ChB" represents the bias application to the charge brush 9 during the time period except the time for charging the secondary transfer residual toner represented by "Ch2". Other reference symbols used herein are similar to those of FIG. 6.

A printing sequence according to Embodiment 1 of the present invention illustrated in FIG. 4 includes the process which is basically similar to that of the comparative example illustrated in FIG. 6, and Embodiment 1 of the present invention employs specific application timing of each bias to the charge brush 9.

Specifically, "ChB" represents the application of the positive bias to the charge brush 9 during a time period when the intermediate transfer belt 10 is driven, and during a time period other than "Ch2". Since "ChB" is provided during the time period other than "Ch2", the discharge of the toner from the charge brush 9 can be suppressed during the time period when the intermediate transfer belt 10 is driven. Accordingly, also in the time period other than "Ch2", the discharge of the toner from the charge brush 9 can be suppressed, with the result that the image defect due to unexpectedly discharged toner can be suppressed. Hereinafter, control for executing "ChB" is referred to as "toner discharge suppressing control".

Note that, in a single printing sequence, the bias application (toner discharge suppressing control) to the charge brush 9 does not have to be constantly performed, and may be performed only in an area to which the image formed on the intermediate transfer belt 10 is primarily transferred. In Embodiment 1 of the present invention, the area to which the image formed on the intermediate transfer belt 10 is primarily transferred is included, and the voltage is applied to the charge brush 9 for a longer period of time. This is because, when the toner discharged from the charge brush 9 onto the intermediate transfer belt 10 remains after the printing sequence, the polarity of the toner is changed in a case where the toner is left for a long period of time, for example, and then it is difficult to clean the toner in some cases. When it is difficult to clean the toner and a cleaning failure occurs, a problem such as an image defect may easily arise. Accordingly, the bias application (toner discharge suppressing control) to the charge brush 9 can be constantly performed during the process for continuously forming an image. In addition, when the intermediate transfer belt 10 moves, a predetermined voltage having the same polarity as that of the charge voltage can be applied to the charge brush 9. In this case, the intermediate transfer belt 10 can be prohibited from starting to move before the predetermined voltage having the same polarity as that of the charge voltage for charging the secondary transfer residual toner remaining on the intermediate transfer belt 10 is applied to the charge brush 9. As a result, the primary transfer process can be more reliably performed during a time period when the area on the intermediate transfer belt 10, to which the predetermined voltage is applied by the charge brush 9, passes the primary transfer portion N1. Alternatively, the toner discharge suppressing control and the cleaning process (secondary transfer residual toner removing process) for the intermediate transfer belt 10 may be performed during a final rotation of the intermediate transfer belt 10 so that the toner does not remain on the outer periphery of the intermediate transfer belt 10 at least after the printing sequence is finished.

To describe the toner discharge suppressing control in more detail, when the secondary transfer residual toner is charged ("Ch2"), for example, a bias of 1.2 kV is applied to the charge brush 9. Further, when the secondary transfer residual toner is not charged ("ChB") during the time period when the intermediate transfer belt 10 is driven, a bias of 1.0 kV is applied to the charge brush 9 for the toner discharge suppressing control. Thus, a voltage value may vary as long as the bias applied to the charge brush 9 during "ChB" has the same polarity as that of the bias applied to the charge brush 9 during "Ch2".

As described above, in Embodiment 1 of the present invention, the image forming apparatus 100 includes the photosensitive drum 1 for bearing a toner image, the movable intermediate transfer belt 10, and the primary transfer roller 6 for primarily transferring the toner image formed on the photosensitive drum 1 onto the intermediate transfer belt 10. The image forming apparatus 100 further includes the secondary transfer roller 8 for transferring the toner image formed on the intermediate transfer belt 10, the brush-shaped charge brush 9 which is brought into contact with the intermediate transfer belt 10 so as to charge the toner remaining on the intermediate transfer belt 10, and the power supply 90 for applying a voltage to the charge brush 9. In this case, in the movement direction of the intermediate transfer belt 10, the charge brush 9 is disposed downstream of the secondary transfer roller 8 and upstream of the primary transfer roller 6. The power supply 90 outputs a charge voltage for charging the toner remaining on the intermediate transfer belt 10. In Embodiment 1 of the present invention, control is performed such that the voltage having the same polarity as that of the charge voltage is applied to the charge brush 9 during the time period when the entire area on the intermediate transfer belt 10, which is to be primarily transferred immediately afterward, passes the area N3 that is in contact with the charge brush 9. As an exemplary embodiment, the intermediate transfer belt 10 is prohibited from starting to move before the voltage having the same polarity as that of the charge voltage is applied to the charge brush 9. In other words, in Embodiment 1 of the present invention, the control is performed such that, immediately before the execution of the primary transfer, the area on the intermediate transfer belt 10 other than the area, which is in contact with the charge brush 9 during the time period when the voltage having the same polarity as that of the charge voltage is applied to the charge brush 9, is prohibited from being primarily transferred.

In Embodiment 1 of the present invention, the operations of the image forming apparatus 100 are controlled as a whole by the controller 14 serving as a control unit provided to the apparatus main body. In particular, according to Embodiment 1 of the present invention, the controller 14 functions as the primary transfer bias control unit 14 as described above, and performs control for starting/stopping a voltage output and an output voltage value (including switching of polarity thereof) of the primary transfer bias power supply 7. Further, according to Embodiment 1 of the present invention, the controller 14 performs control for starting/stopping a voltage output and an output voltage value (including switching of polarity thereof) of the charge bias power supply 90. Still further, the controller 14 is capable of performing control for prohibiting the drive of the intermediate transfer belt 10, control for recognizing the area on the intermediate transfer belt 10, to which the predetermined voltage is applied by the charge brush 9, to prohibit the area other than the recognized area from being primarily transferred, and the like. The controller 14 performs the control using a program stored in a memory unit which is incorporated in the controller 14 or connected to the controller 14.

In this case, in Embodiment 1 of the present invention, the charge bias power supply 90 includes a positive voltage output portion 91 and a negative voltage output portion 92 as voltage output portions. In Embodiment 1 of the present invention, the positive voltage output portion 91 outputs a charge voltage for charging the secondary transfer residual toner remaining on the intermediate transfer belt 10. Further, in Embodiment 1 of the present invention, the negative voltage output portion 92 outputs a voltage for discharging toner from the charge brush 9 onto the intermediate transfer belt 10 in the charge brush cleaning process. The charge bias power supply 90 includes a switch unit 93 for switching the voltage output from the voltage output unit.

Further, in Embodiment 1 of the present invention, at least a secondary transfer bias power supply 7Y of the first image forming portion SY includes a positive voltage output portion 71 and a negative voltage output portion 72 as voltage output portions. In Embodiment 1 of the present invention, the positive voltage output unit 71 outputs a voltage for primary transfer of the toner image onto the intermediate transfer belt 10 from the photosensitive drum 1Y and for transfer of the secondary transfer residual toner back to the photosensitive drum 1 from the intermediate transfer belt 10. Further, in Embodiment 1 of the present invention, the negative voltage output portion 72 outputs a voltage transferring the toner, which is discharged from the charge brush 9 in the charge brush cleaning process, back to the photosensitive drum 1Y from the intermediate transfer belt 10. The secondary transfer bias power supply 7Y includes a switch unit 73 for switching the polarity of the voltage output from the voltage output unit.

Note that, in Embodiment 1 of the present invention, the image forming portion S for collecting the toner from the intermediate transfer belt 10 corresponds to the first image forming portion SY disposed most upstream in the movement direction of the intermediate transfer belt 10, in both the secondary transfer residual toner removing process and the charge brush cleaning process. However, the present invention is not limited thereto. For example, the toner discharged from the charge brush 9 in the charge brush cleaning process may be collected in the image forming portion S other than the first image forming portion SY. In this case, as illustrated in FIG. 1, the primary transfer bias power supply 7 of the image forming portion S (as a whole or a part thereof) other than the first image forming portion SY may have the same structure as that of the primary transfer bias power supply of the first image forming portion SY according to Embodiment 1 of the present invention.

As described above, according to Embodiment 1 of the present invention, it is possible to suppress the generation of the image defect due to the contamination of the intermediate transfer belt 10 caused by the toner unexpectedly discharged from the charge brush 9 or due to the use of the contaminated surface of the intermediate transfer belt 10 for image formation. As a result, a satisfactory image quality can be obtained. Such an effect is extremely remarkable particularly when a member such as a brush with a shape in which toner is liable to be accumulated is used as the member for charging the secondary transfer residual toner.

Embodiment 2

Next, another embodiment of the present invention will be described. A basic structure and operations of an image forming apparatus according to Embodiment 2 of the present invention are similar to those of Embodiment 1 of the present invention. Accordingly, components of Embodiment 2 of the present invention having a function and structure identical or corresponding to those of Embodiment 1 of the present invention are denoted by the same reference symbols, and a detailed description thereof is omitted.

For example, in a case of using the high resistance intermediate transfer belt 10 having an electrical resistance value (volume resistivity) of $10^{10}$ to $10^{13}$ Ω·cm, when the charging is performed by the charge brush 9, the intermediate transfer belt 10 is charged up, whereby a surface potential of the intermediate transfer belt 10 is changed as compared with a surface potential thereof obtained before the execution of the charging. In the impedance detection control as described in Embodiment 1 of the present invention, even when the same voltage is applied, a detected current varies between a case where an area on the intermediate transfer belt 10, which is charged up, enters the primary transfer portion N1 and a case where an area other than the charged-up area enters the primary transfer portion N1.

During continuous printing, the area on the intermediate transfer belt 10, which is charged up during the time period of the primary transfer process, enters the primary transfer portion N1. Accordingly, when the difference in detected current due to the charge-up is taken into consideration, the area on the intermediate transfer belt 10, which is charged up, can be allowed to pass the primary transfer portion N1 during the impedance detection. As a result, under the same conditions as those in the case of printing, the appropriate impedance detection can be performed. However, in a case where the impedance detection is performed when the area, which is not charged up, passes the primary transfer portion N1 (see FIG. 6), the primary transfer bias becomes inappropriate during the continuous printing, with the result that such a failure as a transfer defect occurs.

In other words, there is an object to eliminate the difference in surface potential of the intermediate transfer belt 10, which enters the primary transfer portion N1, between the primary transfer process and the impedance detection process.

Figure 5:
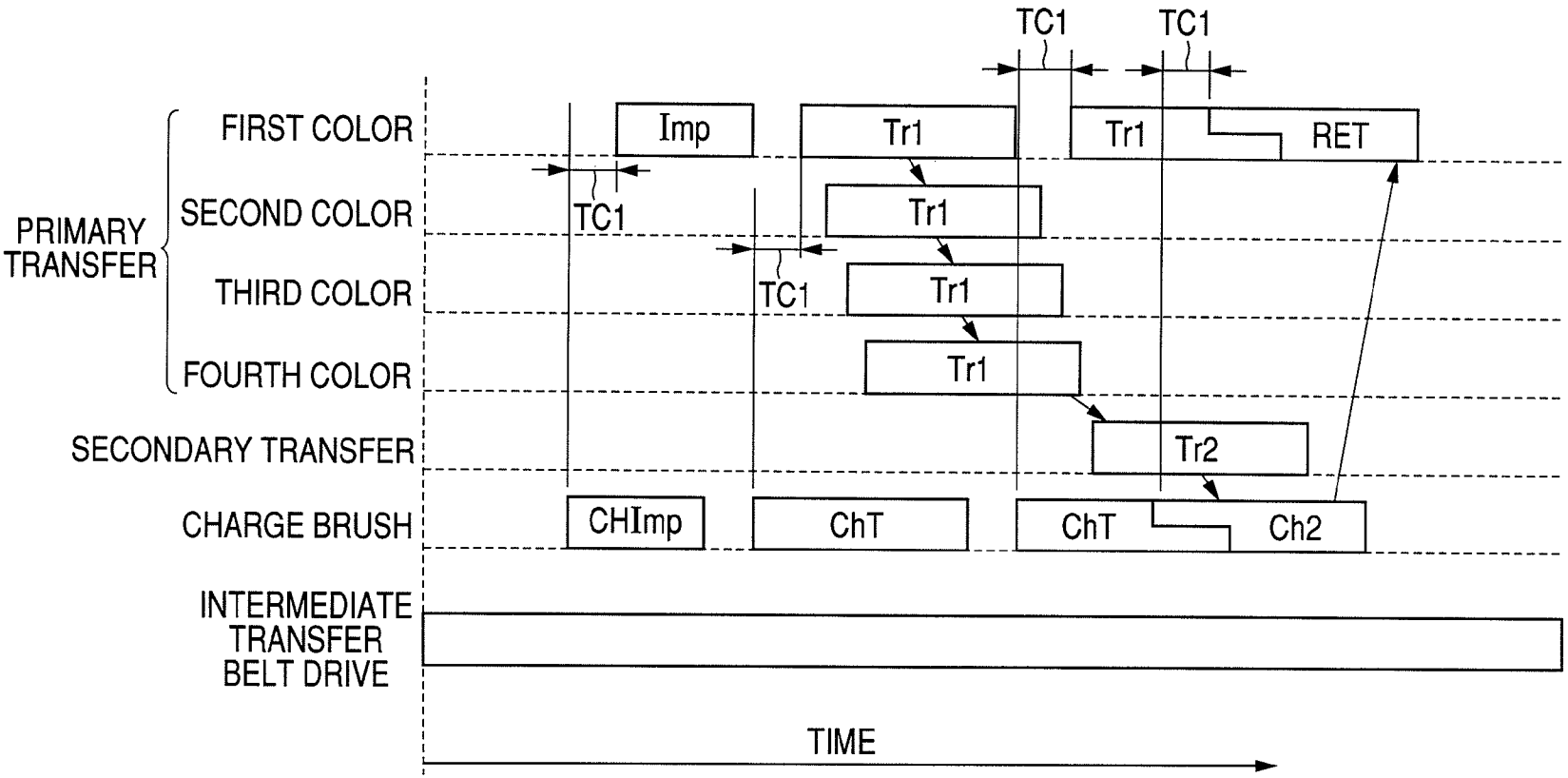
FIG. 5 is a sequence chart illustrating bias application timings in a secondary transfer residual toner removing process and a primary transfer control process according to Embodiment 2 of the present invention.

FIG. 5 is a diagram illustrating bias application timings after the primary transfer process in the printing sequence according to Embodiment 2 of the present invention. In FIG. 5, "ChImp" and "ChT" each represent bias application to the charge brush 9. Other reference symbols are similar to those of FIG. 6.

A printing sequence according to Embodiment 2 of the present invention illustrated in FIG. 5 includes the process which is basically similar to that of the comparative example illustrated in FIG. 6, and Embodiment 2 of the present invention employs specific application timing of each bias to the charge brush 9.

Specifically, "ChImp" and "ChT" represent that the bias is applied to the portion on the intermediate transfer belt 10 to which the bias corresponding to "Imp" and "Tr1" is applied in the primary transfer portion N1 by the charge brush 9, respectively. Both bias values of "ChImp" and "ChT" are set as the same bias value, whereby the portion on the intermediate transfer belt 10, to which the bias corresponding to "Imp" and "Tr1" is applied in the primary transfer portion, can be kept constant in the same charge-up state irrespective of the resistance value of the intermediate transfer belt 10. As a result, the surface potential of the intermediate transfer belt 10 entering the primary transfer portion N1 in the impedance detection control ("Imp") can be set so as to match the surface potential obtained during printing ("Tr1"). Accordingly, the primary transfer bias determined in consideration of the detection results obtained in the impedance detection control has a value appropriate for printing, whereby a satisfactory image can be obtained.

Specifically, in a case where the electrical resistance value (volume resistivity) of the intermediate transfer belt 10 is $10^{12}$ Ω·cm, for example, a bias of 1.2 kV is applied to the charge brush 9 in "ChImp" and in each of "ChT" and "Ch2" for each page.

In this manner, for example, when the volume resistivity of the intermediate transfer belt 10 is $10^{10}$ to $10^{13}$ Ω·cm, and when there is provided the process for detecting the impedance of the primary transfer portion N1 by use of the current detection circuit provided to the primary transfer portion N1, Embodiment 2 of the present invention is extremely effective. In other words, according to Embodiment 2 of the present invention, both the impedance detection process and the primary transfer process can be performed during the time period when the area on the intermediate transfer belt 10, to which the predetermined voltage is applied by the charge brush 9, passes the primary transfer portion N1.

As described above, according the embodiments of the present invention, the bias having the same value is applied to the charge brush 9 in advance, to thereby charge the area on the intermediate transfer belt 10, which passes the primary transfer portion N1 during each time period of the impedance detection control and of the primary transfer process. As a result, the surface potential of the intermediate transfer belt 10 entering the primary transfer portion N1 during the impedance detection control can be set so as to match the surface potential obtained during printing. As a result, a satisfactory primary transfer efficiency can be realized irrespective of the resistance of the intermediate transfer belt 10.

In other words, according to Embodiment 2 of the present invention, in the case of using the intermediate transfer belt 10 having a relatively high resistance, it is possible to reduce the possibility of the generation of the image defect which occurs when the primary transfer control process is inaccurately performed due to the resistance of the intermediate transfer belt 10.

Further, the area on the intermediate transfer belt 10, to which the image is primarily transferred, is charged by the charge brush 9, and the discharge of undesirable toner from the charge brush 9 is suppressed. Accordingly, in the same mechanism as that described in Embodiment 1 of the present invention, in a single printing sequence, the image defect due to the primary transfer of the image onto the toner unexpectedly discharged from the charge brush 9 can be suppressed. In addition, when the bias is constantly applied to the charge brush 9 as described in Embodiment 1 of the present invention, the discharge of undesirable toner from the charge brush 9 can be constantly suppressed.

As described above, while the present invention has been described with reference to exemplary embodiments, the present invention is not limited to the above-mentioned exemplary embodiments. For example, also when another member with the shape in which toner is liable to be accumulated is used in place of the charge brush 9, the effects of the present invention can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-106478, filed Apr. 13, 2007, which is hereby incorporated by reference herein in its entirety.

What is claimed is:

1. An image forming apparatus, comprising:

an image bearing member that bears a toner image;

an intermediate transfer member on which the toner image is transferred as a primary transfer from the image bearing member, the toner image on the intermediate transfer member being transferred onto a recording material as a secondary transfer, the intermediate transfer member being movable;

a power supply; and a charge brush on which a charge voltage is charged from the power supply, for charging a residual toner remaining on the intermediate transfer member after the secondary transfer, wherein during a time period when an area, in which the primary transfer is first performed on the intermediate transfer member in an operation of the image forming apparatus, passes through a position facing the charge brush, the power supply applies a voltage with a polarity that is the same as a polarity of the charge voltage to the charge brush.

2. An image forming apparatus according to claim 1, wherein the power supply outputs the voltage with the polarity that is the same as the polarity of the charge voltage at a time when the intermediate transfer member is started to move.

3. An image forming apparatus according to claim 1, wherein the intermediate transfer member is prohibited from starting to move before the voltage with a polarity that is the same as a polarity of the charge voltage is applied to the charge brush.

4. An image forming apparatus according to claim 1, wherein the residual toner charged by the charge brush is moved to the image bearing member from the intermediate transfer member.

5. An image forming apparatus according to claim 1, wherein the residual toner charged by the charge brush is moved to the image bearing member from the intermediate transfer member simultaneously with the primary transfer.

6. An image forming apparatus, comprising:

an image bearing member that bears a toner image;

a rotary belt that faces the image bearing member, for transferring the toner image onto a transfer material;

a drive roller that supplies tension to the rotary belt and rotates the rotary belt;

a power supply; and a charge brush on which a charge voltage is charged from the power supply, wherein the charge brush contacts the rotary belt and charges toner on the rotary belt, wherein the power supply applies a voltage with a polarity that is the same as a polarity of the charge voltage to the charge brush when the rotary belt starts rotating by the drive roller.

7. An image forming apparatus according to claim 6, wherein the rotary belt is an intermediate transfer belt on which a toner image is primarily transferred from the image bearing member, wherein the charge brush applies charges whose polarities are the same as a polarity of the charge voltage to residual toner remaining on the intermediate transfer belt after a toner image is secondarily transferred from the intermediate transfer belt to the transfer material

8. An image forming apparatus according to claim 7, wherein the power supply switches a voltage applied to the charge brush to the charge voltage when the residual toner remaining on the intermediate transfer belt first contacts the charge brush.

9. An image forming apparatus according to claim 6, wherein an absolute value of a voltage applied to the charge brush by the power supply at a time of when the rotary belt starts rotating by the drive roller is smaller than an absolute value of the charge voltage.

10. An image forming apparatus according to claim 6, comprising a transfer member that forms a transfer section, wherein the transfer member transfers a toner image at the transfer section from the image bearing member to the rotary belt, wherein the toner to which the charge voltage is applied, on the rotary belt, moves at the transfer section from the rotary belt to the image bearing member.

11. An image forming apparatus, comprising:

an image bearing member that bears a toner image;

an intermediate transfer member on which the toner image is transferred as a primary transfer from the image bearing member, the toner image on the intermediate transfer member being transferred onto a recording material as a secondary transfer, the intermediate transfer member being movable;

a power supply; and a charge member on which a charge voltage is charged from the power supply, for charging a residual toner remaining on the intermediate transfer member after the secondary transfer, wherein the charge member has a shape into which a part of toner is accumulated during the residual toner is charged, and wherein during a time period when an area in which the primary transfer is first performed on the intermediate transfer member in an operation of the image forming apparatus passes through a position facing the charge member, the power supply applies a voltage with a polarity that is the same as a polarity of the charge voltage to the charge brush.

* * * * *